US006029301A

United States Patent [19]

Issler et al.

[11] Patent Number: 6,029,301

[45] **Date of Patent: *Feb. 29, 2000**

[54] METHOD FOR CONSTRUCTION OF FOOTWEAR

[75] Inventors: James E. Issler, Greenwich, Conn.; Thomas E. McClaskie, Bethlehem, Pa.

[73] Assignee: Columbia Insurance Company, Omaha, Nebr.

[ * ] Notice: This patent is subject to a terminal disclaimer.

[21] Appl. No.: 09/220,909

[22] Filed: Dec. 24, 1998

[51] Int. Cl.[7] ..... A43B 9/02; A43B 13/28

[52] U.S. Cl. ..... 12/142 B; 12/142 T; 36/19 R

[58] Field of Search ..... 12/142 T, 142 B, 12/142 C; 36/11, 21, 16, 19

[56] References Cited

U.S. PATENT DOCUMENTS

| | | | |
|---|---|---|---|
| 1,869,410 | 8/1932 | David | 12/142 T |
| 2,614,342 | 10/1952 | Hoza | 36/19 R |
| 2,746,177 | 5/1956 | Maccarone . | |
| 2,963,722 | 12/1960 | Stix . | |
| 3,348,251 | 10/1967 | Appleton et al. . | |
| 3,555,705 | 1/1971 | Eder et al. . | |
| 3,583,080 | 6/1971 | Wagner | 36/16 |
| 3,705,463 | 12/1972 | Lown . | |
| 3,784,053 | 1/1974 | Stout . | |
| 4,146,129 | 3/1979 | Wood . | |
| 4,171,046 | 10/1979 | Bonczyk . | |
| 4,182,055 | 1/1980 | Turner, Jr. | 36/16 |
| 4,240,545 | 12/1980 | Stout . | |
| 4,253,564 | 3/1981 | Engdahl, Jr. . | |
| 4,286,709 | 9/1981 | Manizza . | |
| 4,349,103 | 9/1982 | Wood . | |
| 4,430,767 | 2/1984 | Allard . | |
| 4,662,018 | 5/1987 | Autry . | |
| 4,685,223 | 8/1987 | Long | 12/142 T |
| 4,704,808 | 11/1987 | Bianchini et al. . | |
| 4,927,009 | 5/1990 | Stout . | |
| 4,989,779 | 2/1991 | Lashyro . | |
| 5,579,904 | 12/1996 | Holley, Jr. . | |
| 5,611,425 | 3/1997 | Holley, Jr. . | |
| 5,784,736 | 7/1998 | Issler et al. | 12/142 T |
| 5,893,186 | 4/1999 | Issler et al. . | |

*Primary Examiner*—M. D. Patterson
*Attorney, Agent, or Firm*—Fish & Richardson P.C.

[57] ABSTRACT

A method for construction of footwear includes providing an upper defining a volume for receiving a wearer's foot, the upper having a rearward portion with a peripheral lasting edge; providing an outsole having a forward portion, a rearward portion, a walking surface, and a opposed surface opposite to the walking surface, and a cavity formed in at least the forward portion of the opposed surface of the outsole; the method further includes providing and securing resilient material within the cavity of the outsole, and sewing along a peripheral portion of the outsole, the forward portion of the outsole only to the upper. The sewing step includes stitching a thread through the peripheral portion of the opposed surface of the outsole to the walking surface of the outsole. The peripheral lasting edge portion of the upper is lasted along an edge of a last over an insole tuck temporarily secured to the last, and the rearward portion only of the outsole is secured to the lasted rearward portion of the upper.

7 Claims, 7 Drawing Sheets

METHOD FOR CONSTRUCTION OF FOOTWEAR

BACKGROUND OF THE INVENTION

The invention relates to footwear.

There are a wide variety of shoe constructions. One construction method, known as the Opanka construction method, includes hand-sewing the outsole of the shoe to the upper of the shoe along the entire outer periphery of the outsole. However, the Opanka construction method has not been employed in constructing dress shoes, particularly those with dress heels in which the heel is fastened (e.g., by nails, rivets, screws) from the inside of the shoe. For this reason, the opanka construction is generally limited to making sandal-type footwear.

SUMMARY OF THE INVENTION

The invention relates to a method for constructing footwear of the type having an upper, which defines a volume for receiving a wearer's foot, and an outsole.

In a general aspect of the invention, the method includes the steps of providing the upper with a rearward portion having a peripheral lasting edge and an outsole having a forward portion and a rearward portion with a walking surface. The outsole is also provided with an opposed surface opposite to the walking surface, and a cavity formed in at least the forward portion of the opposed surface of the outsole. The method further includes providing and securing resilient material within the cavity of the outsole, and sewing along a peripheral portion of the outsole, the forward portion of the outsole only to the upper. The sewing step includes stitching a thread through the peripheral portion of the opposed surface of the outsole to the walking surface of the outsole. The peripheral lasting edge portion of the upper is lasted along an edge of a last over an insole tuck temporarily secured to the last, and the rearward portion only of the outsole is secured to the lasted rearward portion of the upper.

This hybrid method of shoe construction where the forward and rearward portions of the upper are attached to the outsole using these different methods has several advantages over traditional shoe making techniques. The forward portion of a shoe made following this method has a resilient material disposed within a cavity of the outsole providing a cushiony, buoyant-like feel to its wearers. For this type of construction sewing is a better-suited approach for attaching the upper to the outsole relative to other approaches. Moreover, sewing the upper to the periphery portion of the walking surface of the outsole, as done by this invention, combines the cushiony, buoyant-like comfort of stitching, with a sleek and more secure professional look for the side of the shoes. This construction provides these qualities since stitching a thread to the walking surface of the outsole better secures the upper to the outsole while also preventing the thread from being visible to observers looking at the shoe from its side.

The rearward portion of the shoe on the other hand generally requires more structural rigidity to absorb forces received by the shoe and wearer's foot during walking. An insole tuck (which is typically rigid and may include a reinforcing member) is positioned within the rearward portion of the shoe and serves to support the heel which is attached to the outsole, as well as the wearer's foot. For this type of construction, lasting is a preferable method of attaching the rearward portion of the outsole to the upper. Moreover, lasting also provides a tighter, sleeker appearance to the shoe since there are no surfaces along the periphery of the outsole required for sewing.

Thus, this hybrid approach to shoe construction combines the advantages of increased comfort and a secure professional appearance at the front portion of a shoe along with good support and attractiveness at the rear portion of the shoe.

In embodiments of this invention, the method may also include one or more of the following steps. A peripheral channel is formed along the peripheral portion of the outsole for receiving the stitched thread. Holes are formed between the opposed surface of the outsole and a peripheral channel of the outsole to aid stitching the thread. A recessed outer periphery portion is formed along the peripheral portion of the walking surface of the outsole. A peripheral channel is formed along the recessed outer periphery portion of the outsole for receiving the stitched thread. And finally, holes are formed between the opposed surface of the outsole and the channel in the recessed outer periphery portion of the outsole to aid in stitching the thread.

These embodiments of the invention protect the stitched thread from being worn as the wearer of the shoe walks. These embodiments also define a contact portion on the walking surface of the shoes which helps make a more durable shoe.

Other advantages and features of the invention will be apparent from the following description of presently preferred embodiments, and from the claims.

DESCRIPTION OF THE PREFERRED EMBODIMENTS

Figure 1:
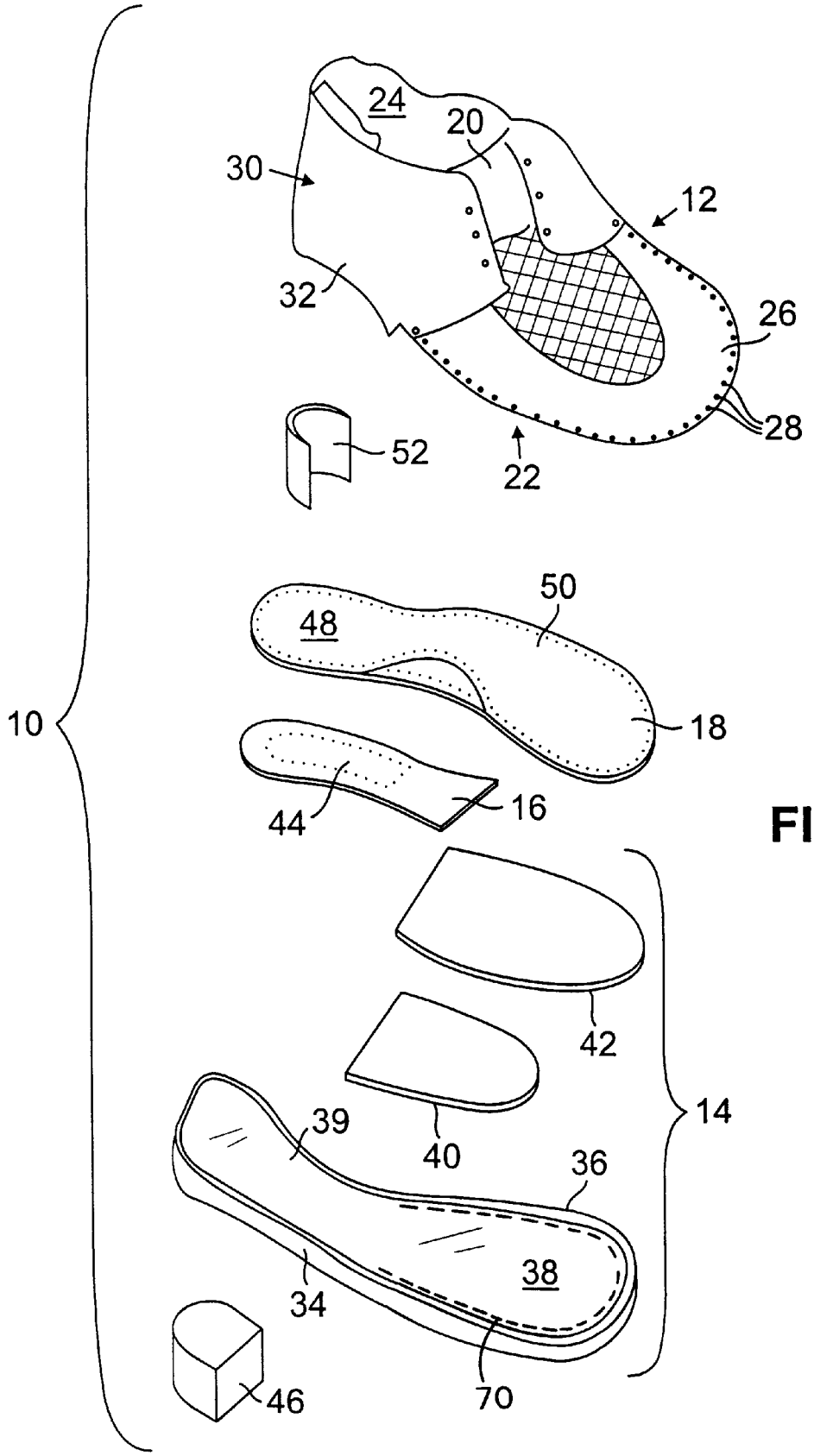
FIG. 1 is an exploded perspective view of the component parts of a shoe constructed in accordance with the invention.

Referring to FIG. 1, a shoe 10 includes a shoe upper 12, an outsole assembly 14, a insole tuck 16 and a sock liner 18.

Shoe upper 12, preferably made from leather, has a tongue 20 extending into a vamp portion of the upper, and eyelets for receiving conventional front lacing (not shown). The shoe upper 12 is shown free-floating, with its bottom portion 22 open to what will be the internal volume of the shoe. Shoe upper also includes an inner liner 24 which is sewed to the inner surface of upper 12 and is fabricated of materials (e.g., soft leather) selected to provide comfort to the wearer during walking. At this stage of construction, the shoe is said to be a sewed upper with bottom portions of both upper 12 and inner liner 24 open.

Shoe upper 12 is similar to conventional uppers except that a front portion 26 of the upper is shaped to accommodate pre-punched holes 28 around its periphery. Front portion 26 extends from the toe region to about half the length of the upper near a region where the arch of the wearer's foot would be positioned. Holes 28 are used, as will be described below, in the construction of the front portion of the completed shoe.

A rear portion 30 of upper 12 includes a lasting edge 32 which, as will be described below, is used in the construction of the rear portion of the completed shoe.

Figure 7:
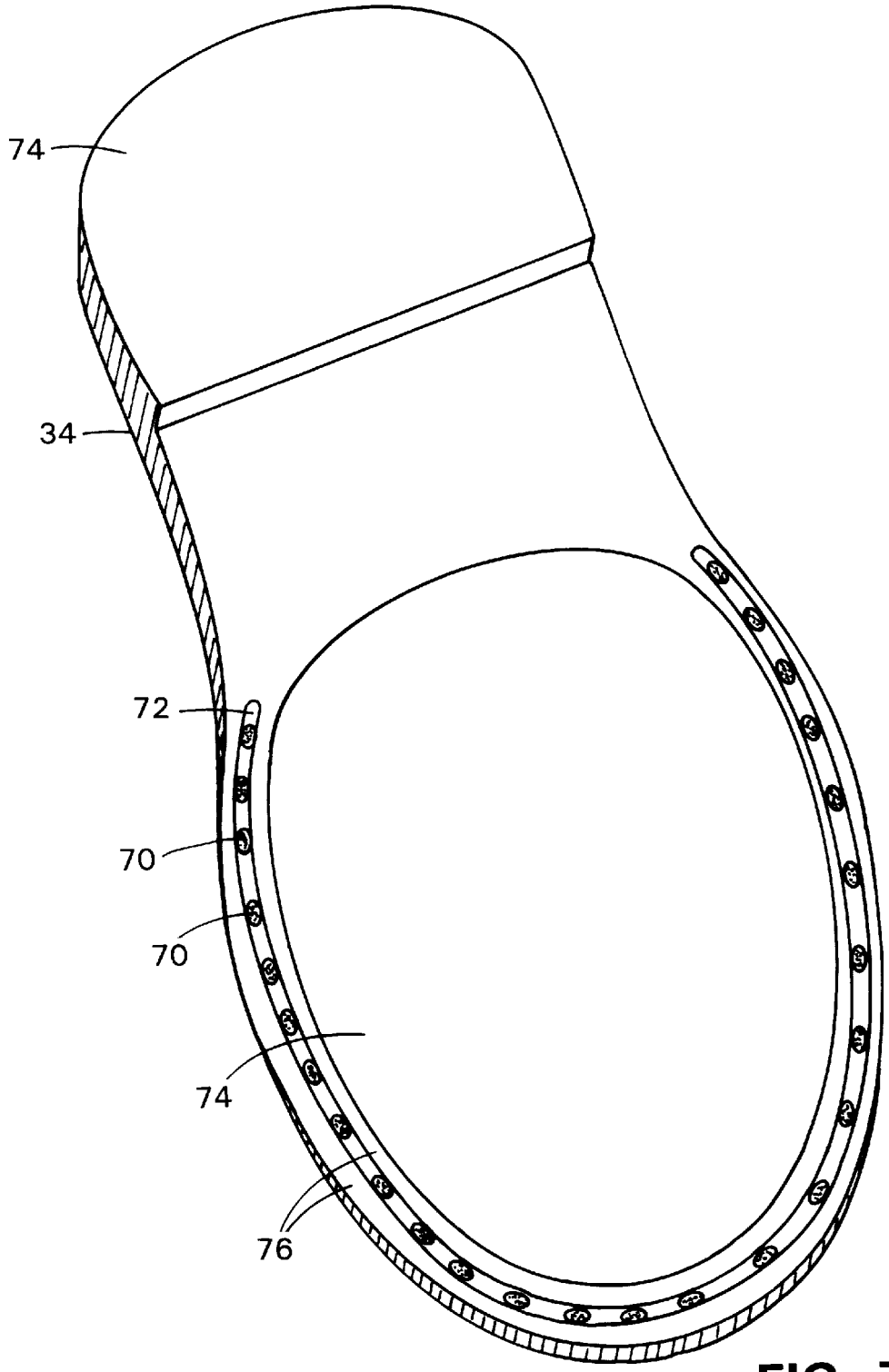
FIG. 7 is a bottom perspective view of the walking surface of the outsole.

Outsole assembly 14 includes an outsole 34, formed of molded polyurethane, with an integrally molded, upstanding sidewall 36 extending around its periphery. Outsole 34 includes a bottom walking surface 78 (FIG. 7) and an opposed surface 39 opposite to the walking surface.

Referring now to FIG. 3, and 7–9, the front portion of walking surface 78 of outsole 34 includes a flat, recessed peripheral portion 76 containing a channel 72, which defines a contact surface 74 raised from the recessed peripheral portion. A series of holes 70 formed in channel 72 and extending through the outsole 34 receive a thread 51 (FIG. 3) stitched with a tool 80. As will be described in greater detail below, holes 70 are used to secure upper 12 to outsole assembly 14. Because recessed peripheral portion 76 with channel 72 is offset from walking surface 78, thread 51 is protected during walking. Thread 51 is formed of a relatively strong, wear resistant material (e.g., polyester or nylon). In essence channel 72 protects thread 51 by preventing the thread from contacting the ground as the wearer of shoe 10 walks. Furthermore, recessed peripheral portion 76 defines a raised contact surface 74 which provides even greater protection to thread 51 by ensuring that the raised contact surface 74 wears against the ground and not recessed periphery portion 76 containing channel 72 and thread 51.

Referring again to FIG. 1, the depressed opposed surface 39 of the outsole 34 and the sidewall 36 together define a cavity 38 having a depth ranging from about 2 mm to about 4 mm. Outsole assembly 14 also includes a cushioning layer 40 formed of polyurethane foam having an uncompressed thickness of about 2 mm to 6 mm. Cushioning layer 40 is slightly smaller than cavity 38 to provide a peripheral edge on surface 39 for adhesively securing the cushioning layer within the cavity using a relatively thin cover layer 42 formed of fiber or leather.

Insole tuck 16 is formed of a rigid fiber material and includes a metal reinforcement shank 44 (shown in dashed lines) which is embedded within the insole tuck. Insole tuck 16 extends generally from the heel of the shoe to the edge of cushioning layer 40 and provides the structural rigidity to the rear portion of the shoe where it is most needed. Moreover, insole tuck 16 supports a heel 46 which is attached to outsole 34.

Sock liner 18 includes an inside layer 50 (shown in dashed lines) formed of a polyester material and covered by a top layer 48, e.g. of pigskin leather. In some embodiments, inside layer 50 may be decoratively quilted to provide an aesthetically pleasing look to the interior surface of the shoe.

The construction method of shoe 10 will now be described in conjunction with the figures.

In preparation for constructing shoe 10, a counter or back stiffener 52 (FIG. 1) is inserted into upper 12 to provide structural support to the heel portion of shoe. This counter is, for example, formed of a thermoplastic material on a counter-forming machine using heating and cooling molds.

Outsole assembly 14 is constructed by inserting cushioning layer 40 within cavity 38 and securing it therein by adhesively attaching cover layer 42 to upper surface 39 of outsole 34. The rear portion (i.e., that part not covered by cover layer 42) is primed and provided with a layer of adhesive. As will be described in greater detail below, insole tuck 16 is then temporarily secured to the rear section of a last.

Figure 2:
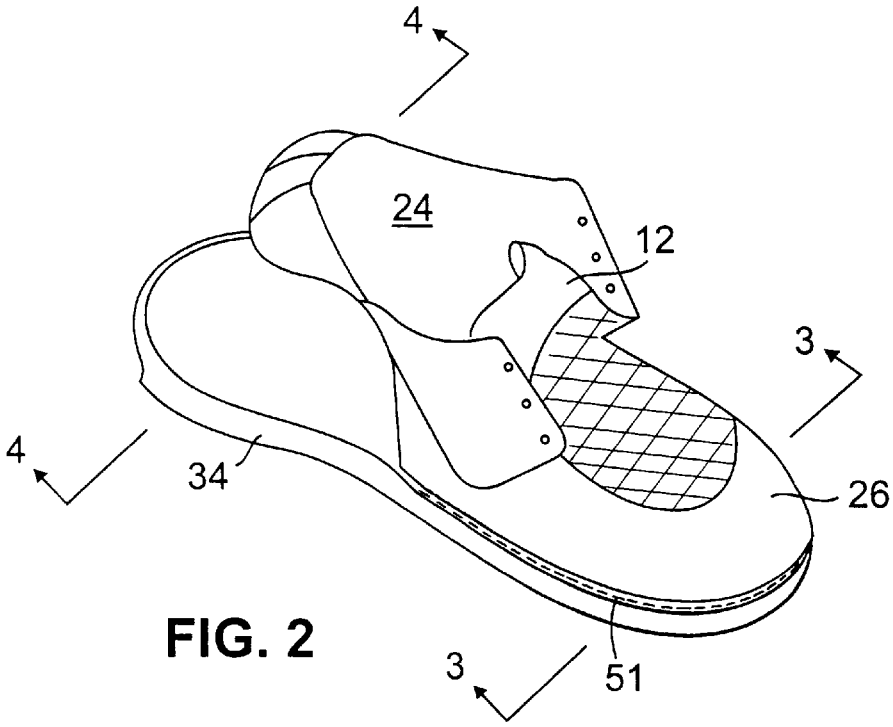
FIG. 2 is a perspective view of the shoe of FIG. 1, partially constructed showing the front portion of the shoe sewed to an outsole.
Figure 3:
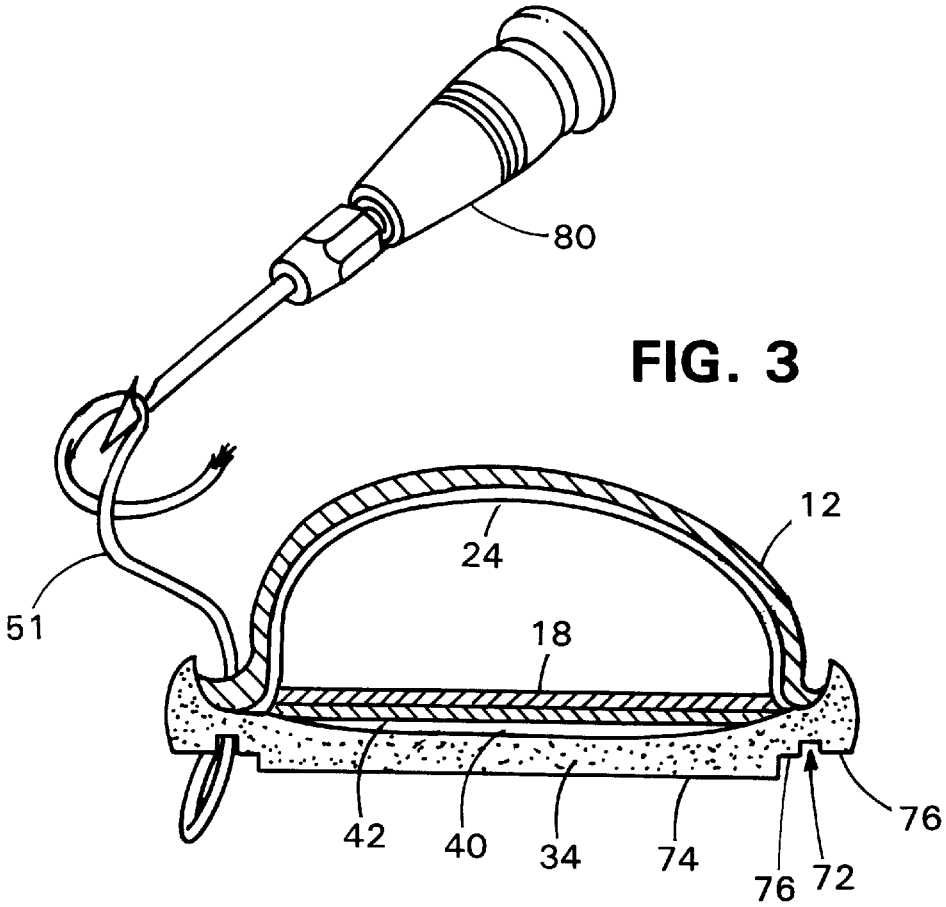
FIG. 3 is a cross-sectional view of the shoe taken along lines 3—3 of FIG. 2.
Figure 8:
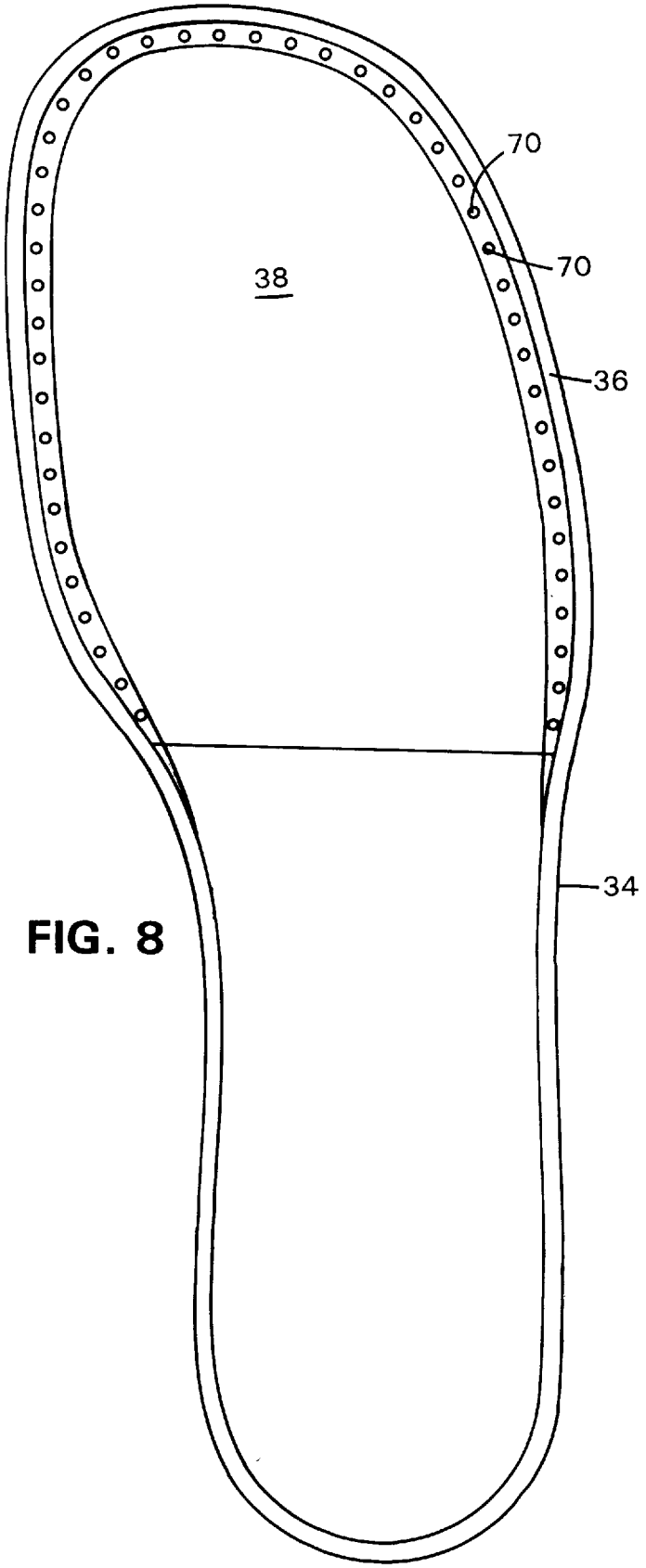
FIG. 8 is a top view of the opposed surface opposite to the walking surface of the outsole of the shoe.
Figure 9:
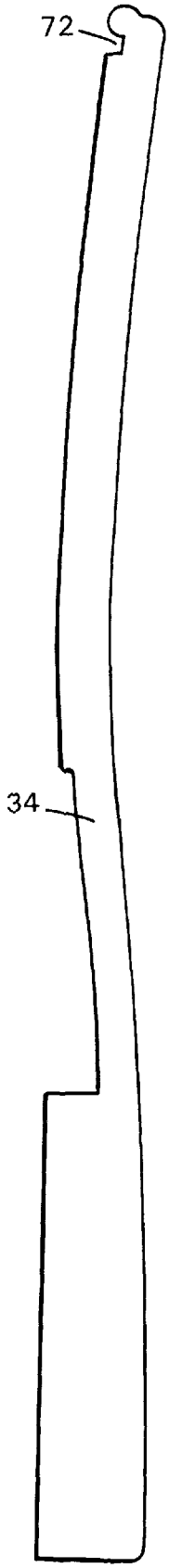
FIG. 9 is a side view of FIG. 8.

Referring to FIGS. 2, 3 and 8, the front portion 26 of upper 12 is hand-sewn to outsole assembly 14 using thread 51 which is alternately threaded using tool 80 from holes 70 of outsole 34 to pre-punched holes 28 of upper 12.

After the outsole assembly has been sewn to upper 12, the rear portion of shoe 10 is constructed using a lasting process.

As is known in the art, lasting involves tightly shaping the upper over the contour of a last, a piece of wood or synthetic material roughly following the shape of the foot and acting as a form on which the shoe is made.

In the embodiment of this invention, a last having a McNeil-type hinge is used. This type of last includes a stationary front section hinged together with a movable heel section which swings upward and forward with respect to the front section. In particular, the last is inserted into the front portion of the shoe (including the sewed-on outsole) with the heel section of the last in its open-hinged position. Insole tuck 16 is temporarily tacked to the heel section of the last. The rear portion of the shoe is then pulled over the heel section of the last. Thereafter, the hinge is closed to provide heel-to-toe tension to the shoe.

Figure 4:
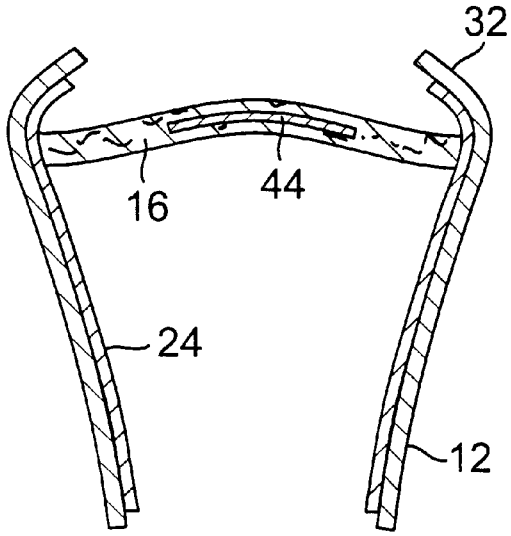
FIG. 4 is a cross-sectional view of the rearward portion of the shoe taken along lines 4—4 of FIG. 2 illustrating a lasting operation.
Figure 5:
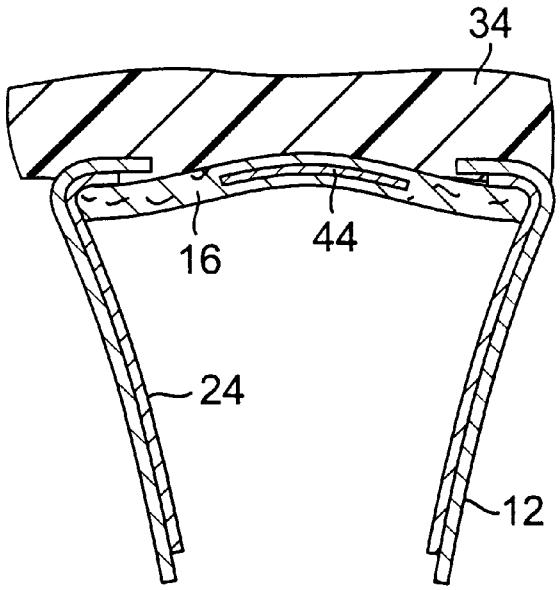
FIG. 5 is a cross-sectional view of the rearward portion of the shoe taken along lines 5—5 of FIG. 6 after lasting and an outsole (without heel) is attached thereto.

Referring to FIG. 4, a lasting operation is performed with the lasting edge 32 of upper 12 "wiped" in overlying relationship to insole tuck 16. A conventional adhesive may be used to permanently bond the wiped-over lasting edge 32 to the insole tuck or may be "heel-seat" lasted with tacks or nails.

Figure 6:
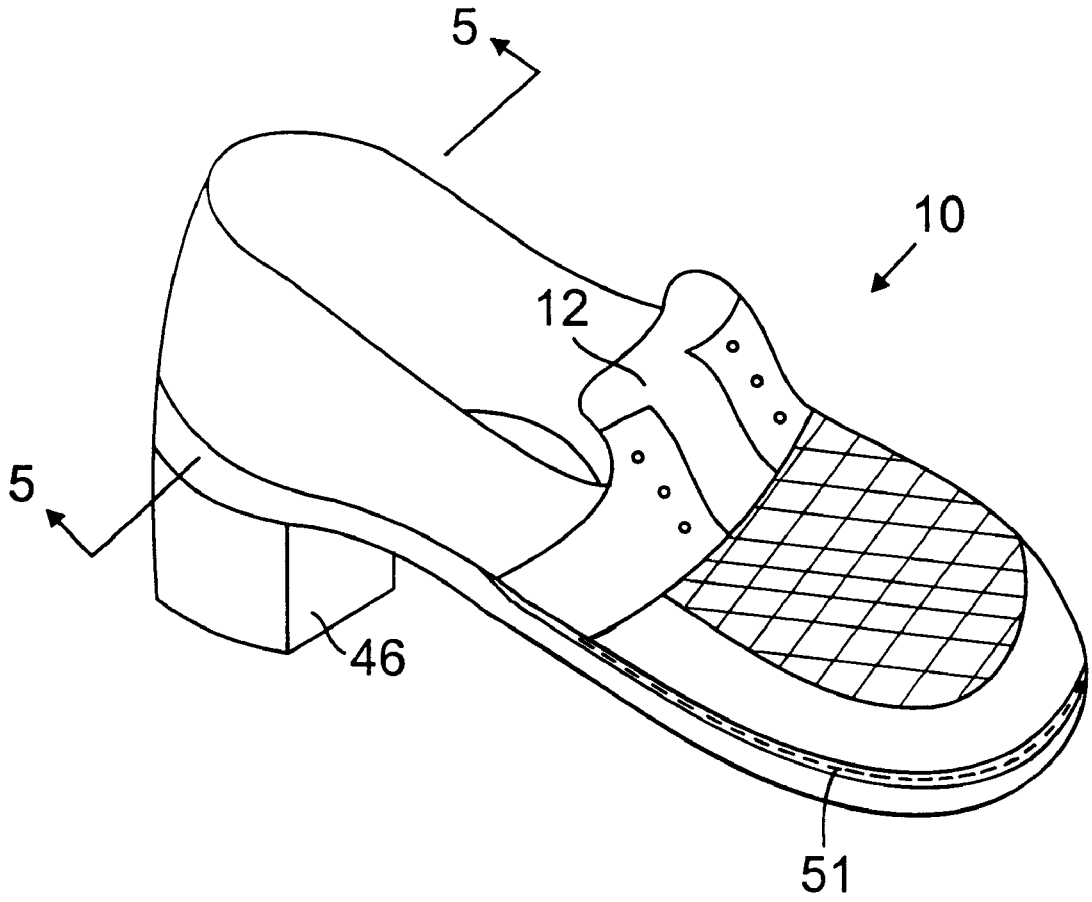
FIG. 6 is a perspective view of the completed shoe of FIG. 1.

The rear portion of outsole assembly 14 is then adhesively bonded upon the bottom of the rear portion of the lasted upper. The last is then removed from the shoe and heel 46 is attached through insole tuck 16 and outsole 34 using fixation members (e.g., rivets, screws). For added security, the area of the outsole underlying shank 44 can be stitched through insole tuck 16. Finally, sock liner 18 is inserted over the insole tuck 16 and into the volume of upper 12 within which the wearer's foot is to be inserted. The completed shoe is shown in FIG. 6.

Other embodiments are within the following claims. For example, although a last having a McNeil-type hinge was used in constructing the rearward portion of the shoe in the above embodiment, lasts with other hinge arrangements (e.g., telescopic hinges) may alternatively be used.

What is claimed is:

1. A method for construction of footwear comprising the steps of:

providing an upper defining a volume for receiving a wearer's foot, the upper having a rearward portion with a peripheral lasting edge;

providing an outsole having a forward portion, a rearward portion, a walking surface, an opposed surface opposite to the walking surface, and a cavity formed in at least the forward portion of the opposed surface of the outsole;

providing and securing resilient material within the cavity of the outsole;

sewing, along a peripheral portion of the outsole, the forward portion only of the outsole to the upper, the sewing includes stitching a thread through the peripheral portion of the opposed surface of the outsole to the walking surface of the outsole;

lasting, along an edge of a last, the peripheral lasting edge portion of the upper over an insole tuck temporarily secured to the last; and securing the rearward portion only of the outsole to the lasted rearward portion of the upper.

2. The method of claim 1 further comprising the steps of:

forming, along the peripheral portion of the outsole, a peripheral channel for receiving the thread.

3. The method of claim 2 further comprising the steps of:

forming, in the peripheral channel of the walking surface of the outsole, holes from the opposed surface of the outsole to the walking surface of the outsole for receiving the thread.

4. The method of claim 1 further comprising the steps of:

forming, along the walking surface of the outsole, a recessed outer periphery portion of the outsole.

5. The method of claim 4 further comprising the steps of:

forming, along the recessed outer periphery portion of the outsole, a peripheral channel for receiving the thread.

6. A method for construction of footwear comprising the steps of:

providing an upper defining a volume for receiving a wearer's foot, the upper having a rearward portion with a peripheral lasting edge;

providing an outsole having a forward portion, a rearward portion, a walking surface, a raised contact surface, a recessed outer periphery portion in the walking surface defining the raised contact surface, a channel in the recessed outer periphery portion, an opposed surface opposite to the walking surface, and a cavity formed in the forward portion of the opposed surface of the outsole;

providing and securing resilient material within the cavity of the outsole;

sewing, along the peripheral portion of the outsole, the forward portion of the outsole only to the upper, the sewing includes stitching a thread through holes in the peripheral portion of the opposed surface of the outsole to be received in the channel in the walking surface of the outsole;

lasting, along an edge of a last, the peripheral lasting edge portion of the upper over an insole tuck temporarily secured to the last; and securing the rearward portion only of the outsole to the lasted rearward portion of the upper.

7. A method for construction of footwear comprising the steps of:

providing an upper defining a volume for receiving a wearer's foot, the upper having a rearward portion with a peripheral lasting edge;

providing an outsole having a forward portion, a rearward portion, a peripheral portion, a walking surface, an opposed surface opposite to the walking surface, and a cavity formed in at least the forward portion of the opposed surface of the outsole, the peripheral portion being recessed from the walking surface and including a peripheral channel for receiving a thread;

providing and securing resilient material within the cavity of the outsole;

sewing, along the channel, the forward portion only of the outsole to the upper, the sewing includes stitching the thread through the peripheral portion of the opposed surface of the outsole to the walking surface of the outsole;

lasting, along an edge of a last, the peripheral lasting edge portion of the upper over an insole tuck temporarily secured to the last; and securing the rearward portion only of the outsole to the lasted rearward portion of the upper.

* * * * *